United States Patent [19]

Brulfert et al.

[11] 4,012,181

[45] Mar. 15, 1977

[54] ENGINE WITH ROTOR, OF NEW TYPE

[76] Inventors: Andre Brulfert, 6, rue des Peintres Parrocel; Andre Gabriel Hoss, 23 Boulevard Saint-Ruf, both of Avignon, Vaucluse, France, 84000

[22] Filed: Aug. 4, 1975

[21] Appl. No.: 601,608

Related U.S. Application Data

[63] Continuation-in-part of Ser. No. 441,216, Feb. 11, 1974, Pat. No. 3,914,075.

[30] Foreign Application Priority Data

Feb. 12, 1973 France ..... 73.04931
Feb. 20, 1973 France ..... 73.05946

[52] U.S. Cl. ..... 418/144; 418/213; 418/243; 277/81 P; 277/96.1

[51] Int. Cl.[2] ..... F01C 19/08; F03C 3/00; F04C 15/00; F16J 15/16

[58] Field of Search ..... 418/139, 141, 142, 144, 418/212, 213, 243–251; 277/96 A, 81 P, 96.1

[56] References Cited

UNITED STATES PATENTS

| | | | |
|---|---|---|---|
| 610,497 | 9/1898 | Probst | 418/139 |
| 872,801 | 12/1907 | Eek et al. | 418/144 |
| 1,575,860 | 3/1926 | Monk | 418/144 |
| 2,722,201 | 11/1955 | Muse | 418/144 |
| 3,193,186 | 7/1965 | Peras | 418/144 |
| 3,514,236 | 5/1970 | Rashev | 418/144 |

FOREIGN PATENTS OR APPLICATIONS

| | | | |
|---|---|---|---|
| 1,526,393 | 4/1970 | Germany | 418/144 |

*Primary Examiner*—John J. Vrablik
*Attorney, Agent, or Firm*—Finnegan, Henderson, Farabow & Garrett

[57] ABSTRACT

The present invention relates to rotary engines of the type comprising a casing, assembled with two transverse end-plates and constituting a stator equipped with fluid-admission and exhaust tubes; a rotor associated with means for displacing said rotor in the stator so as to form working chambers with this latter; and rectilinear segments freely mounted in rectilinear grooves provided respectively along generator lines of said casing, corresponding to the separation edges of the working chambers on the internal surfaces of each end-plate, following at least three directions and forming a polygon surrounding the rotor-displacement means by virtue of a crossed arrangement, by overlapping of segments in pairs, especially along the radial directions corresponding to said casing segments and extending at least up to a segment of said polygon, each of these segments co-operating with other segments by slots or notches forming expansion clearances.

The invention provides greatly improved fluid-tightness between the moving parts of the rotor in the stator by means of a reticular structure of rectilinear segments, and the structure is practically immune to the effects of very large variations of gas pressure which may arise during the operating cycle of the engine.

10 Claims, 23 Drawing Figures

FIG.1
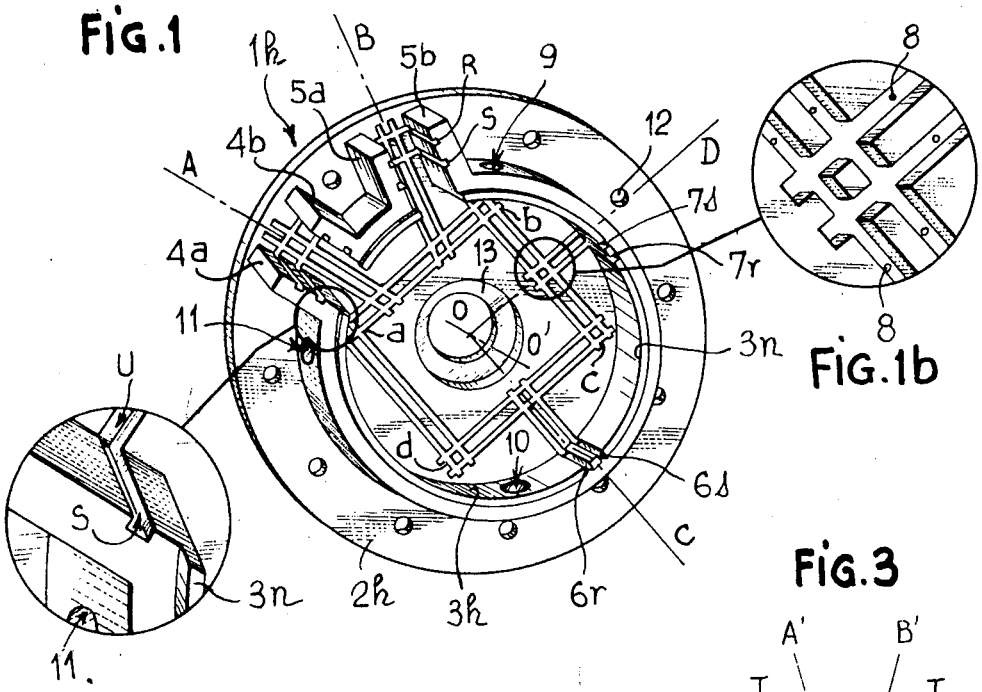
FIG.1b
FIG.1a
FIG.2
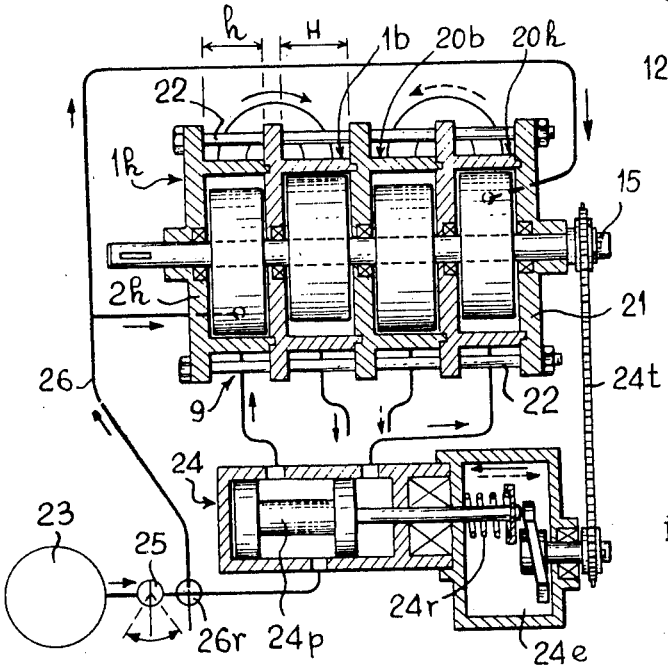
FIG.3
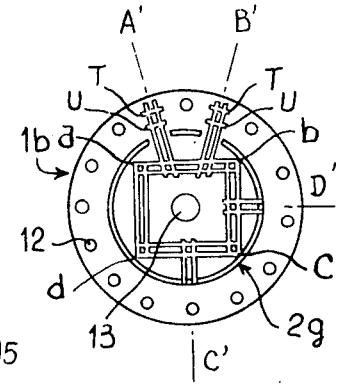
FIG.4
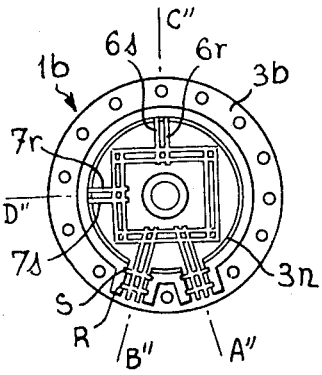

ENGINE WITH ROTOR, OF NEW TYPE

The present application is a continuation in part of the U.S. patent application Ser. No. 441,216 of Feb. 11, 1974 now U.S. Pat. No. 3,914,075.

The invention relates to a fluid-tight segment device assembled together in the form of a reticular structure applicable to an engine with a rotor of a type having either a circular movement or an epicycloidal movement.

It is known to mount, in grooves formed in the walls (cylindrical or lateral and flanks) of an engine stator, fluid-tight sealing segments forming a reticular structure for a rotor capable of being displaced in this stator for the purpose of thereby ensuring the fluid-tightness of the working chambers which are formed between this stator and this rotor, during the course of each displacement cycle of said rotor.

Thus, the U.S. Pat. No. 3,193,186 to PERAS describes an engine with four lobes capable of effecting an epicycloidal movement in a stator having five cavities so as to form working chambers appropriate to the various phases of a working cycle based on the principle of internal combustion.

In an engine of this kind, the edges of the cylindrical stator wall separating two adjacent cavities are equipped with radial partition means which co-operate with the cylindrical faces of the rotor lobes, whereas the stator flanks comprise grooves fitted with strips forming two polygons surrounding the displacement system of the rotor and ensuring fluid-tightness on the faces of the corresponding flanks of this rotor. These fluid-tightness means and strips or segments constitute a reticular structure which is practically fixed and inside which the rotor is capable of moving.

Although the various segments of this structure are not subject to troublesome effects of inertia or centrifugal force, this structure does not ensure adequate fluid-tightness due to the particularly high values of temperatures and pressures of gas which are periodically generated in the above-mentioned working chambers.

The invention proposes to overcome these drawbacks.

It has for its object a reticular structure of segments applicable to an engine constituted by:

A casing and two end-plates equipped with fluid-admission and exhaust tubes;

a rotor associated with a system of movement of a rotational or epicycloidal type in the said stator, the segments of the said structure forming two flank polygons surrounding the displacement system of the rotor and associated with each other by elements mounted radially with respect to the casing.

An essential object of the invention is to propose a structure of the type above-mentioned which is practically inert with respect to the effects of very large variations of gas pressure which may be produced during the course of an operating cycle of the engine.

Another main object of the invention is to ensure by means of such a structure, an excellent fluid-tightness for high values of the temperature of the fluid effecting the operation of the engine.

Another object of the invention is to propose a structure of the type above-mentioned, which can conveniently be produced from simple parts, which is relatively inexpensive and easy to maintain.

The essential objects referred to above are achieved, according to the invention, by utilizing rectilinear segments to the exclusion of any other type and by ensuring the necessary assemblies of the polygonal segments of each flank by overlapping.

Other characteristic features and advantages of the invention will become apparent from the description which follows below with reference to the accompanying drawings, the said description and drawings being given by way of example only and not in any limitative sense.

In the drawings:

FIG. 1 shows a perspective view of an essential part of a rotary engine equipped with a structure according to the invention;

FIGS. 1*a* and 1*b* show details of the element of FIG. 1, to a larger scale;

FIG. 2 represents diagrammatically an axial cross-section of an engine equipped with a structure according to the invention;

FIGS. 3 and 4 show respectively the front and rear faces of an element similar to that of FIG. 1;

Figure 5:
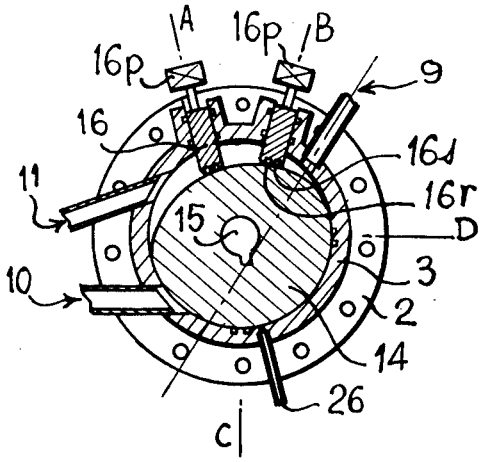
FIG. 5 shows the engine of FIG. 2 in transverse section.
Figure 8:
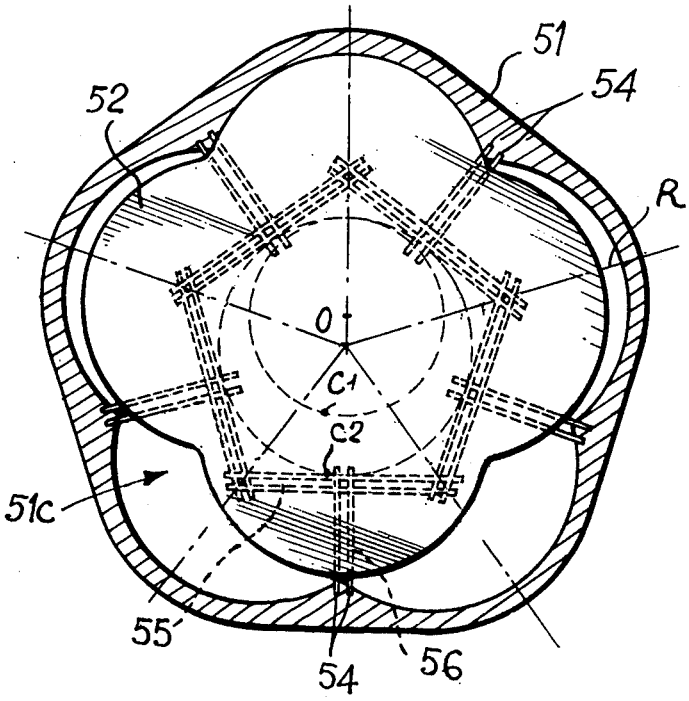
Figure 9:
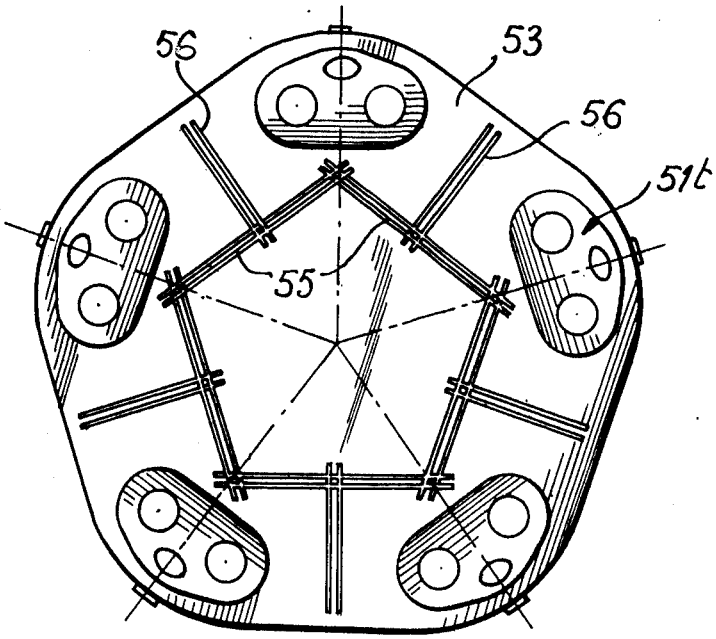

FIGS. 6*a* to 6*g* represent respectively in perspective, in longitudinal cross-section and in plan view, a fluid-tight segment for a structure according to the invention;

FIGS. 7*a* to 7*g* are diagrams making it possible to explain how fluid-tight segments must be mounted so as to constitute a structure according to the invention;

FIGS. 8 and 9 are figures similar to FIGS. 3 and 5, and relate to an alternative form of fluid-tight structure in accordance with the invention.

In FIGS. 1 and 2, there can be seen an element 1*h* comprising a circular disc 2*h* and a composite portion 3*h* in the form of a hoop or casing, circular and coaxial to the disc 2*h* and having a smaller diameter than that of this disc so as to form an external flange. This hoop has two pairs of wings 4*a*, 4*b* and 5*a*, 5*b* identical to each other and approximately radial, between which the hoop 3*h* is broken so as to form two radial passages.

The wings of each pair are in fact parallel to each other and parallel to a radial plane OA (or OB) passing through the geometrical axis OO′ of the element 1*h*, the angle formed by these two planes OA, OB being of the order of 20°.

The internal and circular face of the hoop 3*h* has two rectilinear grooves 6*r*, 6*s*, parallel to each other and to the axis OO′, located symmetrically on each side of the bisecting plane OC of the dihedron formed by the planes OA, OB of the wing passages. The transverse section of these grooves, identical to each other, is rectangular.

This internal face of the hoop 3*h* also comprises two other grooves 7*r*, 7*s*, identical to the grooves 6*r*, 6*s* and forming another group of grooves symmetrically disposed with respect to a radial plane OD, perpendicular to the radial plane OC.

Each of the faces, located facing and parallel to each other, of the wings 4*a* to 5*b* is provided with grooves "R, S" similar to the grooves 6*r* to 7*s* and also parallel to the geometrical axis 00′ of the hoop 3*h*. The grooves "R" on the one hand and the grooves "S" on the other, of the two wings of a passage are located respectively in the two planes perpendicular to the radial plane of symmetry OA (or OB) of this passage.

In addition, the part of the face which is located, on the disc 2*h*, between the wings 4*a*, 4*b*, has two grooves "T, U" (in FIG. 3), identical to the previous grooves R, S and respectively located level with the extremities of these latter, perpendicular to the plane OA.

In this way, the passage of the wings 4*a*, 4*b* comprises two transverse grooves of U-shape, and the other passage of the wings 5*a*, 5*b* also comprises two transverse grooves RTR-SUS identical with these latter.

In addition, this face of the disc or end plate 2*h* comprises a system of rectilinear grooves similar to the grooves referred to above. These grooves are distributed in pairs of grooves parallel to each other:

Along the four sides of a square "*a*, *b*, *c*, *d*" parallel to the geometrical axes OC, OD and surrounding the centre of the disc 2*h*;

along the above-mentioned axes OC, OD of the grooves 6*r*, 6*s* and 7*r*, 7*s*, while forming respectively with these latter L-shaped grooves;

along the axes OA, OB of the wing passages 4*a* to 5*b*.

It will be observed that the grooves of each of these passages with axes OA or OB cross the grooves T, U of this passage and those of the side ab of the square. Similarly, the end portions of the grooves with axes OC and OD cross respectively the grooves of the sides cd and bc of the square. Finally, the extremities of the sets of grooves corresponding to each apex of the square cross each other.

In addition, small holes 8, formed in the disc 2*h* and in the wings 4*a* to 5*b* open into these grooves so as to form a lubrication circuit which will be referred to again later.

Furthermore, the edge of the hoop 3*h* has an annular rib 3*n* provided for centering on another element 1*b*, similar to the elenent 1*h* described above, by means of a groove suitably provided on this element 1*b*.

This latter is in fact constituted by a disc 2*b* which comprises on one of its faces a composite hoop 3*b* (see FIG. 4) having two radial ring passages, a groove system identical to the corresponding parts described above, the height "H" of this hoop 3*b* being slightly greater than that of the hoop 3*h* (see FIG. 2).

The other face of the disc 2*b* comprises a circular groove 2*g* coaxial to the disc 2*b*, the transverse profile of which is appropriate to that of the above-mentioned groove 3*n* (see FIG. 3) for the purpose of the assembly together of these two elements by means of rods 22 engaged in holes 12 suitably distributed over the end portions, forming flanges, of the discs 2*h* and 2*b* (see FIG. 2).

Two other elements 20*h*, 20*b* respectively identical to the elements 1*h*, 1*b*, are also associated coaxially with these latter by the rods 22 and nuts by means of an endplate 21 which comprises a face identical to that of the element 1*b*, shown in FIG. 3.

The face of the disc 2*b* having the assembly groove 2*g* (FIG. 3) also comprises disc grooves identical to those of the discs 2*h* or of its other face (FIG. 4) but displaced by 180° with respect to these latter. The same thing applies to the faces of the other elements 20*h*, 20*b* and 21.

Furthermore, as shown in FIG. 5, a member 14 in the form of a straight, semi-circular and semi-elliptic cylinder is housed in the stator, which results from the assembly of the element 1*h* and 1*b* by means of its keying on a shaft 15 which is mounted in a conventional manner in bearings fixed in housings 13 provided in the discs 2*h*, 2*b*, coaxially to the hoop 3*h*, the radius of the circular part of the "rotor" 14 thus formed being slightly smaller than that of the internal surface of this circular hoop 3*h*.

This shaft 15 is sufficiently long to carry three other rotors which are similarly provided in the other three stators formed by the elements 1*b*, 20*b*, 20*h* and 21.

In addition, as shown in FIG. 5, each of the passages formed by the wings 4*a* to 5*b* of these stators is equipped with an element 16 provided in the form of a parallelepiped rectangle of transverse section appropriate to its free sliding movement in its passage. In the radial direction, its height is sufficient to be applied by one of its two free faces on the cylindrical surface of its rotor 14, by the thrust effect of a known means 16*p* (spring, hydraulic device . . . ), this contact face on the rotor having two grooves 16*s*, 16*r* similar to those described above and parallel to the geometrical axis of the shaft 15.

Finally, the hoops 3*h* of these stators are provided with holes 9 and 10, 11 respectively equipped with fluid-admission and exhaust tubes and the admission tubes 9 of the stators 1*h*, 20*h* (FIG. 2) are coupled to a known device 24 with a piston slide-valve 24*p* having two heads, which is actuated in synchronism with the rotation of the shaft 15 by an eccentric cam 24*e* against the force of a restoring spring 24*r*, by means of a transmission 24*t* ensuring the rotational drive of this cam 24*e*.

The admission tubes 9 of the other two stators 1*b* and 20 are respectively coupled in a suitable manner to the exhaust tubes of these stators 1*h*, 20*h* so as to be supplied in compound from these latter.

The fluid-tightness of the chambers thus formed in these stators by the partitions 16 and the rotors 14 is ensured by sealing joints (described below) suitably mounted in the grooves of these elements.

Figure 6A:
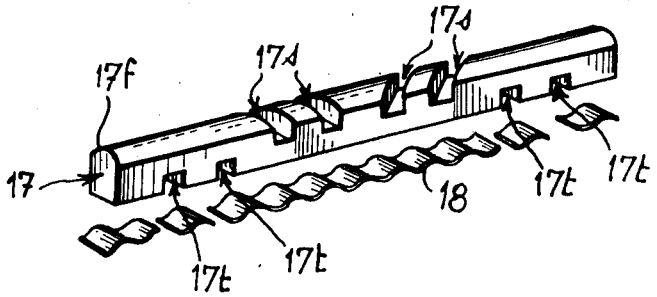
Figure 6B:
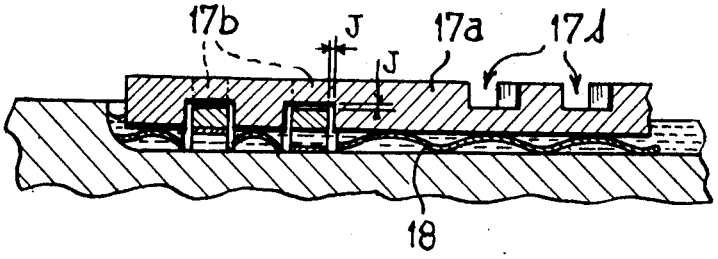

In FIG. 6*a* there can be seen a rectilinear rod 17, the section of which is approximately rectangular. One of its sides 17*f* may be convex. The dimensions of this section are adapted for an engagement and a free movement of this rod 17 in a groove of the element 1*h* or 1*b*. Each end portion of the face forming a heel opposite the transversely-domed face 17*f* of this rod 17, comprises two transverse rectangular slots 17*t*, suitable for a free engagement in a similar slot of another similar rod, arranged square with respect to this rod 17 so as to effect an assembly of the type of "half-wood assemblies" made by carpenters (see FIGS. 6*b* and 6*c*).

The transversely-domed face 17*f* is also provided with four rectangular slots 17*s* formed slantwise in appropriate pairs respectively for assemblies of the above-mentioned type for other rods arranged parallel to each other in pairs in two opposite directions inclined with respect to the rod 17.

Elements 18 of corrugated strip in elastic material (spring steel for example) have dimensions similar to the heel portions formed by the slots and are arranged below this heel.

It will be understood that the grooves of the discs 2*h*, 2*b* may be equipped with elements 18 and with rods associated with each other by suitable slots. This is also true of the grooves 6*r* to 7*s* of the hoop 3*h* and the grooves R, S, T, U of the wings 4*a* to 5*b*, the extremities of these hoop-rods and wings co-operate in a fluid-tight manner with the extremities of the corresponding rods of the discs by means of "half-lap" slot arrangements (see FIG. 6*d*) or mitre joints similar to those of carpenters.

Finally, the grooves of the partitions 16 are also provided with elastic means 18 and rods of smaller width than that of the rod 17. Furthermore (see FIG. 6*e*), the rods 19 of the passage with axis OA (or OB) comprise each on their domed face a groove of the mortice type, the length of which is adapted to the travel of the partitions 16 under the effect of eccentricity of the semi-elliptic face of the rotor 14 and the extremities of the partition rods 16*a* have a width adapted to that of these mortices and are engaged with light friction in these latter in the manner of a tenon.

The width of the rods 19 may be slightly greater than that of the other rods 17 so as to facilitate the arrangement of this sliding mortice of the corresponding extremity of the partition rod 16*a*.

The dimensions of the slots and especially the depth (see FIG. 7*a*) are sufficiently large so that a rod 17*a* for example does not interfere with the rods 17*b* and 17*c* which cross it, in their movements for a good contact on the rotor 14. The width of the slots is therefore practically equal to that of the grooves (see FIG. 6*c*).

It will be understood that an elastic fluid under pressure (air, steam . . . ) may be supplied to the engine thus constituted from a conventional source 23 shown in FIG. 2, the fluid-tightness of the chambers BOD, BOC . . . COA formed successively in each stator by the elliptic face of its rotor being ensured by the practically-fixed structure segments which surround this rotor, namely:

the radial segments of the grooves in the casing 6*r*, 6*s*, 7*r*, 7*s* and 16*r*, 16*s* corresponding to the cylindrical rotor face;

the segments of the grooves in the plate "*a.b*", "*b.c*", "*c.d.*", "*d.a*", of the flanks forming a polygon round the shaft 15;

the segments of the grooves in the plate of the flanks which associate polygon sides with the corresponding extremities of radial segments for the cylindrical rotor face.

It should be specified that, for a stator in which the diameter of the hoop 3*h* is of the order of 100 mm. and in the case of a vapour temperature comprised between 250° and 500°, the width and the height of the transverse section of the segments 17 will be of the order of 2.4 mm. Furthermore, the widths of their grooves should ensure clearances "J" of the order of 15/100 with tolerances at most equal to 3/100. These widths will therefore be comprised between 2.73 and 2.7 mm.

The rectilinear segments of this structure ensure a surprising fluid-tightness which makes possible an exceptional efficiency.

In this connection, it will be indicated that, due to the effect of the fluid pressure, which may be higher than 50 bars, the segments may be inclined transversely (FIG. 7*b*) in their guiding groove (arrow *f*1) due to the above-mentioned clearances J. In all cases however, their face 17*f* (domed in this example) provides friction surfaces on the rotor which may be reduced to a rectilinear contact edge. These friction surfaces are very small in all cases and their contacts on the rotor under the thrust of the strips 18, are excellent.

Figure 6C:
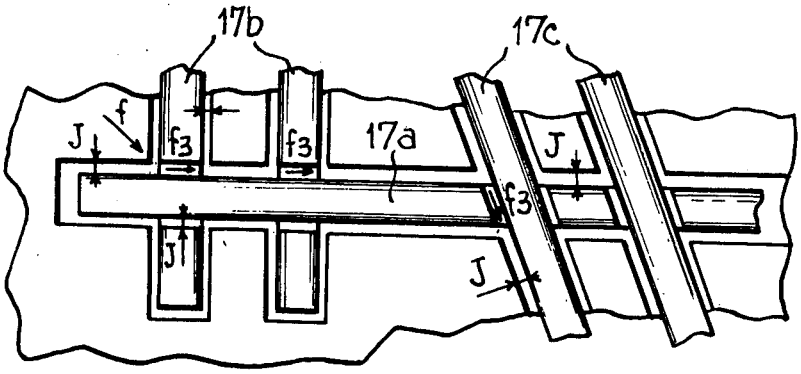
Figure 6F:
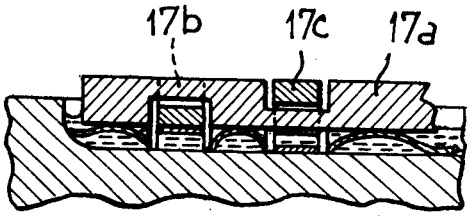
Figure 6D:
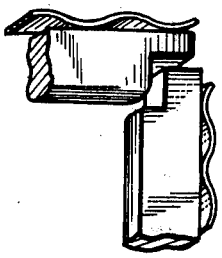
Figure 6G:
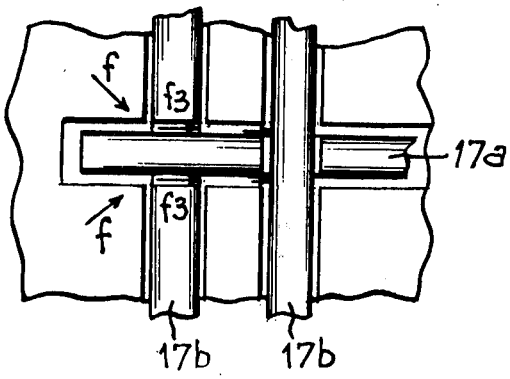
Figure 6E:
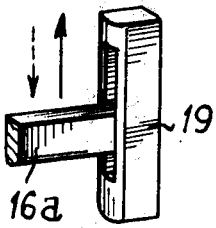
Figure 7A:
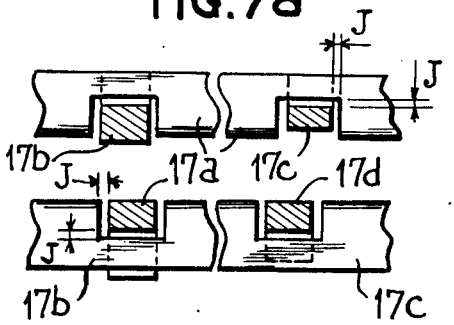
Figure 7B:
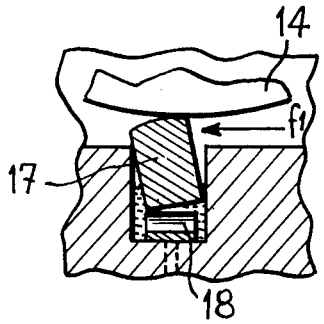

In addition, as shown in FIGS. 6*c* and 7*a*, the relative dimensions of the slots such as 17*t*, 17*s* ensure the assembly by overlap of two flank segments and must also provide sufficient clearances to permit this possible transverse rocking movement of one of the segments by the effect of pressure, without interfering with the free movements of the other segment, these clearances forming in the slots a labyrinth of channels which does not cause practically any leakage of fluid.

In this connection, as shown in FIG. 6*c*, due to the clearances J, the space between the flanks of a groove (or a slot) and the corresponding segment forms a leakage channel for the driving fluid (arrows *f*3) but this channel is very small. The lubricating oil admitted through the holes 8 ensures, in a conventional manner, good fluid-tightness between the bottom of each groove and the heel of its segment. In addition (see FIGS. 6*f*, 6*g*) the two slots of a segment 17*a* for the assembly of two segments 17*b*, associated in pairs, can be opposite each other so as to form a barrier in this leakage channel.

The same conditions apply (see FIG. 7*c*) for the dimensions of the slots formed on the edges of flank segments and radial segments of the grooves 6*r* to 16*s*. As the lengths of these elements are smaller than those of their grooves in order to avoid effects of mutual thrust from their extremities (arrows *f*2) which could act contrary to the fluid-tightness of the structure.

Figure 7C:
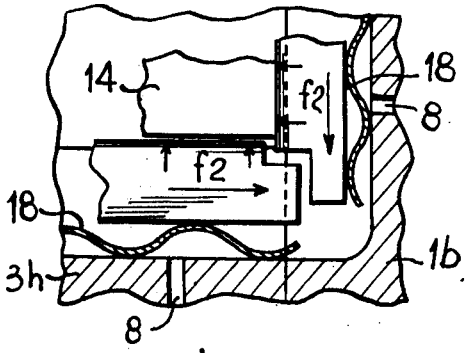
Figure 7G:
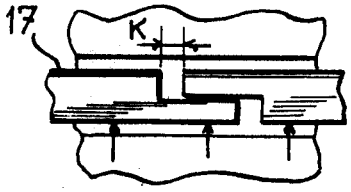
Figure 7D:
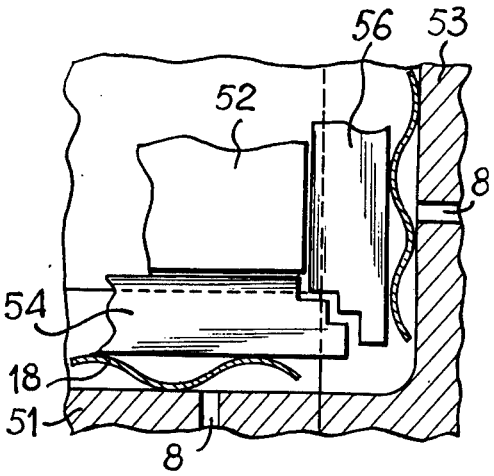
Figure 7E:
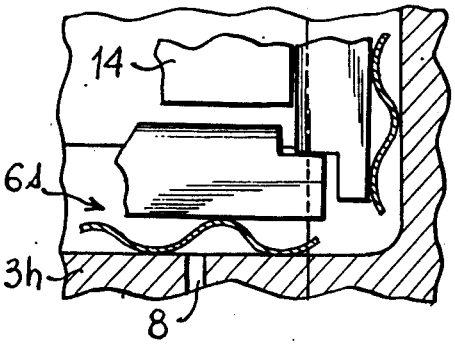
Figure 7F:
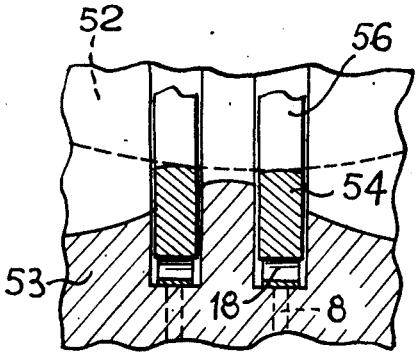

By virtue of these arrangements, it will be understood from FIGS. 7*c* and 7*d*, that the flank segments of this structure and also those of the partition passages 16 are always applied against one corresponding flank face of the stator or of its partitions 16.

The radial segments of the grooves 6 or 7 of the hoops (see FIG. 7*e*) only co-operate with the circular part of the circular face of the rotor and are disengaged from this latter when the elliptic face is presented. The end slot faces of these radial segments then come into abutment against the end slot faces of the segments OC or OD which associate them with the corresponding segments of the polygon *a*, *b*, *c*, *d*, surrounding the shaft 15. This has the effect of holding these radial segments in their grooves 6 or 7 and reducing the labyrinth of the faces of these segment extremity assemblies.

Finally, the movements of these segments in their grooves are limited to small oscillations which generate a pumping phenomenon which facilitates their lubrication; the supply to the holes 8 may be effected by known devices. Furthermore, these movements oppose any excess lubrication and any mixture of the lubricant with the driving fluid.

The nature of the segments (and also that of the stator and rotor elements) is obviously appropriate to the nature of the driving fluid in order to avoid attacking effects of this latter. In the case of steam for example, the segments 17 will be of bronze having a high proportion of tin, but in the case of compressed air they may have a base of graphitic cast-iron.

In addition, the structure described above may be adapted to the equipment of engines comprising a rotor subjected to a complicated movement, for example a lobar rotor to which is given an epicycloidal movement, such as the internal combustion engine which has been described in the U.S. Pat. No. 3,193,186 referred to above.

As shown in FIGS. 8 and 9, an engine of this type comprises essentially a stator hoop 51 having five cavities 51*c* identical to each other, suitably distributed about a geometrical axis 0 and suitable for the successive engagement of four lobes, identical to each other, of a rotor 52, by means of a known displacement mechanism giving an epicycloidal movement to this rotor in the stator. From the geometrical point of view, this movement may be generated by rolling without slip of a circle C1 bound to the rotor on a circle C2 bound to the stator, and larger than the circle C1 and surrounding this latter.

In a manner similar to that of the element 1*h*, 1*b* . . . , the hoop 51 may be assembled on two end-plates 53 such as that shown in FIG. 9. These end-plates comprise five groups of admission and exhaust tubes 51*t* corresponding to the five cavities of the hoop in order to ensure the operating service of the working chambers which are successively formed during the course of each displacement cycle of the rotor, as is well known.

In order to ensure excellent fluid-tightness and in consequence a good efficiency for this engine, the stator formed by the hoop 51 and the two end-plates 53 comprise rectilinear grooves fitted with rectilinear segments assembled together in the form of a structure similar to that described above.

This structure comprises, in fact:

segments 54 mounted radially in grooves formed parallel in pairs on the parts forming edges which separate the cavities of the hoop 51;

segments 55 mounted in grooves of each end-plate 53 forming a polygon with five sides, enclosing the displacement mechanism of the rotor 52;

segments 56 mounted in grooves of each end-plate 53 and respectively associating the radial segments 54 of one hoop edge with the corresponding side of the above-mentioned polygon.

On each of the end-plates 53, the segments 55 of one side of the polygon co-operate with those of the two adjacent sides by crossing and overlapping by means of slots, as has been explained above.

The same thing applies to the segments 55 and the segments 56 which associate them with the radial segments 54. Finally, these radial segments 54 co-operate with these coupling segments 56 by slots of the same type as those made by carpenters (see FIGS. 7*c* and 7*d*).

It should be specified that the length of the rectilinear segments 54 to 56 is smaller than that of their groove in order to form, even while hot, sufficient clearances to permit the small movement of these segments. Similarly, the overlap assembly slots must have sufficiently large clearances so that each segment cannot interfere with the movements of the other segments which it crosses or with which it is associated perpendicularly at the end, taking account of expansion effects which may appear due to the action of the temperature of the gases, which may reach a value of 1800° to 2000°.

For example, for the stator of FIGS. 8 and 9 having a radial dimension OR of the order of 110 mm. (corresponding to a diametral dimension of about 220 mm.) the width of the segments will be of the order of 2.5 millimeters and their height will be about 3 millimeters.

For this internal combustion engine, the clearances J of the segments in their grooves and in the overlapping slots will be of the order of 25/100ths of a millimeter and (taking account of the tolerances) they will be between 23 and 30/100ths.

In order to prevent troublesome action by segments associated by overlapping, due to substantial elongations of relatively long segments by the effect of the high temperatures referred to above, there may be utilized several shorter segments (see FIG. 7*g*) associated together end to end in a single groove by slots of the half-lap joint type forming clearances K sufficient to constitute conventional expansion joints.

The segments 54 must be formed obviously as close as possible to the separation edges of the hoop cavities 51 in order that the movements in height of these segments are not too great with respect to their height, so as thereby to ensure their satisfactory guiding.

However, in the case where these movements could be too great to permit this satisfactory guiding, it would be possible to arrange, in each part of the hoop 51, corresponding to a separation edge of two adjacent cavities, a passage similar to the wing passage 4*a*, 4*b* comprising segment grooves R, S, T, U for the fluid-tight sliding movement of a radial partition provided with segments similar to the partition 16 described above.

Finally, rectilinear segments could be utilized in the form of bunches of three segments or more in grooves parallel to each edge of the recticular fluid-tightness structure in dependence on the number of barriers necessary for this fluid-tight sealing so as to counterbalance the pressure of the gases admitted or produced in the working chambers.

The invention having now been described and its advantage shown with reference to a detailed example, the Applicants reserve to themselves the exclusive rights for the whole duration of the patent without limitation other than that comprised in the terms of the appended claims.

What is claimed is:

1. In a rotary engine having at least one rotor:

a stator for the rotor, said stator including a pair of end plates, a casing at least partially surrounding said rotor and joining said end plates at each end, and fluid admission and exhaust tubes;

rotatable means journaled in said end plates for displacing the rotor to form working chambers in the stator; and a network of rectilinear grooves formed on the internal surfaces of said casing and said end plates and rectilinear segments mounted in each of said grooves sized smaller than the grooves for both lateral and longitudinal movement therein, said network including:

a. groups of at least two grooves and segments each across said casing radially arranged with respect to said rotatable means;

b. groups of at least two grooves and segments each polygonally arranged around said rotatable means in said end plates and c. groups of at least two grooves and segments each interconnecting said radially and polygonally arranged groups of grooves and segments;

each of said segments cooperating with at least one other segment through interacting cut-away portions of the segments, said cut-away portions permitting both lateral and longitudinal movement of the segments.

2. In a rotary engine, a network of grooves and segments as in claim 1 wherein a plurality of segments associated with each other in end-to-end relationship with half-lap joints is contained in a single groove, said half-lap joints permitting longitudinal movement among the plurality of segments.

3. In a rotary engine, a newtwork of grooves and segments as in claim 1 wherein said segments are resiliently biased against the rotor.

4. In a rotary engine, a network of grooves and segments as in claim 1 also including apertures in the bottoms of at least one of said grooves for access to lubrication, and wherein said lateral and longitudinal movements of said network act as a pump for said lubrication.

5. In a rotary engine as in claim 1, a plurality of said rotors and stators in end-to-end relationship with respect to said rotatable means and having one of said end plates in common between adjoining rotors and wherein said polygonally arranged groups of grooves and segments are utilized on opposite sides of said common end plates, said polygonally arranged groups on opposite sides of an end plate being identical in pattern but shifted 180° with respect to each other.

6. In a rotary engine, a network of grooves and segments as in claim 1 wherein said interconnecting segments cooperate with said polygonally arranged segments intermediate the ends of the polygonally arranged segments.

7. In a rotary engine, a newtwork of grooves and segments as in claim 6 wherein said interconnecting segments cooperate with said polygonally arranged segments substantially at the center of the polygonally arranged segments.

8. In a rotary engine, a network of grooves and segments as in claim 1, wherein each of said groups includes parallel pairs of grooves and segments.

9. In a rotary engine, a network of grooves and segments as in claim 8 in which the ends of the parallel pairs of said polygonally arranged groups and interconnecting groups extend beyond intersected grooves and segments.

10. In a rotary engine, a network of grooves and segments as in claim 8 wherein at the interconnections of said parallel pairs of grooves and segments the cutaway portions of said pairs are formed by interacting transverse slots in the segments, and wherein at the intersections of said parallel pairs of grooves and segments the two slots provided in one segment for the intersecting pair of segments are on opposite sides of the one segment.

* * * * *